United States Patent [19]

Tardivel

[11] Patent Number: 4,512,570

[45] Date of Patent: Apr. 23, 1985

[54] ROPE CLIMBING EXERCISE APPARATUS

[75] Inventor: Georges M. Tardivel, Flagstaff, Ariz.

[73] Assignee: Monique M. Tardivel, Venice, Calif.

[21] Appl. No.: 467,852

[22] Filed: Feb. 17, 1983

[51] Int. Cl.[3] ..... A63B 7/04

[52] U.S. Cl. ..... 272/112; 272/132; 182/42

[58] Field of Search ..... 272/111, 112, 132, 85–89, 272/90, 61, 62, 63, 113, 91, 93, 76–78, 133; 254/338, 299; 182/3–5, 231, 235

[56] References Cited

U.S. PATENT DOCUMENTS

| | | | |
|---|---|---|---|
| 641,519 | 1/1900 | Kerns | 272/132 |
| 890,898 | 6/1908 | Gaillac | 272/133 |
| 1,228,694 | 6/1917 | Netcott | 272/91 |
| 3,103,344 | 9/1963 | Figge | 254/338 |
| 3,358,968 | 12/1967 | Walsh et al. | 254/299 |
| 3,380,447 | 4/1968 | Martin | 272/62 |
| 3,599,974 | 8/1971 | Price | 272/132 |
| 3,782,718 | 1/1974 | Saylor | 272/112 |
| 3,784,193 | 1/1974 | Simjian | 272/132 |

FOREIGN PATENT DOCUMENTS

| | | | |
|---|---|---|---|
| 2509425 | 10/1976 | Fed. Rep. of Germany | 272/112 |
| 2840412 | 3/1980 | Fed. Rep. of Germany | 272/112 |
| 2420983 | 11/1979 | France | 272/111 |
| 47702 | 2/1977 | Japan | 272/112 |
| 597876 | 4/1978 | Switzerland | 272/61 |

*Primary Examiner*—Richard J. Apley
*Assistant Examiner*—S. R. Crow
*Attorney, Agent, or Firm*—Harvey B. Jacobson

[57] ABSTRACT

Support structure is provided for support in elevated position above a support surface upon which a user may be disposed. An elongated section of flexible tension member is mounted from the support structure by guide structure mounted thereon and the tension member includes releasably joined opposite ends. The tension member is supported from the guide structure for longitudinal shifting relative thereto and with a closed loop of the tension member depending downwardly from the support structure. The guide structure includes adjustable friction brake structure for yieldingly braking the tension member against longitudinal shifting relative to the guide structure With the brake structure adjustably applied, the reach of the tension member furthest from the support structure may be used by a climber and the friction braking on the tension member may be adjusted to effect a friction drag against longitudinal shifting of the tension member which is equivalent to less than the weight of the user. In this manner, the user may exercise his arms in the same manner in which a person climbs a rope, but with less climbing effort than otherwise required by the user. In addition, a horizontally elongated seat structure is provided with clamp assemblies at its opposite ends releasably engageable with the depending reaches of the tension member to thereby provide a swing and a horizontally elongated chinning bar is also provided with clamps at its opposite end for releasably clampingly engaging the depending reaches of the tension member.

12 Claims, 13 Drawing Figures

ROPE CLIMBING EXERCISE APPARATUS

BACKGROUND OF THE INVENTION

Many young persons as well as adults are becoming more interested in finding various ways to effect body exercise and in many instances elaborate gym equipment is not available to these persons. In addition, while jogging and rope skipping are exercises which may be effected in substantially any environment, these exercises contribute primarily to leg muscle development and toning and do not provide for other muscle toning. Accordingly, a need exists for an inexpensive apparatus which may be used by children as well as adults and which includes various features thereof enabling many different exercises to be carried out in a manner which may be considered as appealing to many users rather than as dull and thus unappealing.

BRIEF DESCRIPTION OF THE INVENTION

The exercising apparatus of the instant invention is constructed in a manner whereby it may be supported from any suitable upright or upstanding wall and further incorporates structure which will allow the exercising apparatus to be horizontally swung between a retracted out of the way position and an extended operative position relative to its support structure.

The exerciser includes elevated support structure from which an elongated tension member such as a rope is guidingly supported for longitudinal shifting relative to the support structure with opposite end portions of the rope depending downwardly from the support structure and having terminal ends removably joined together to form a continuous rope. The support structure includes adjustable friction brake means for variably braking the tension member against longitudinal shifting relative to the support structure and in this manner the reach of the rope furthest from the support structure may be "climbed" with only the desired amount of frictional resistance. Still further, the exercising apparatus includes a horizontally elongated seat for removable support between the depending reaches of the rope as well as a horizontally elongated chinning bar for removable support between the depending reaches of the rope. Also, various attachments are provided on the exercise apparatus to enable different forms of body exercises to be effected therewith.

The main object of this invention is to provide an inexpensive, portable and easily usable exercise apparatus which may be utilized to accomplish various different body exercises.

Another object of this invention is to provide an exercise apparatus which may be supported in elevated operative position either from a vertical upright post or from an upper portion of a vertical wall.

Still another important object of this invention is to provide an exercising apparatus including adjustment means whereby the basic exercise to be effected in conjunction therewith may be carried out successfully with a varied amount of effort.

Yet another object of this invention is to provide an exercising apparatus constructed in a manner such that the numerous exercises to be performed in conjunction therewith are appealing not only to children but also to adults.

A final object of this invention to be specifically enumerated herein is to provide an exercising apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
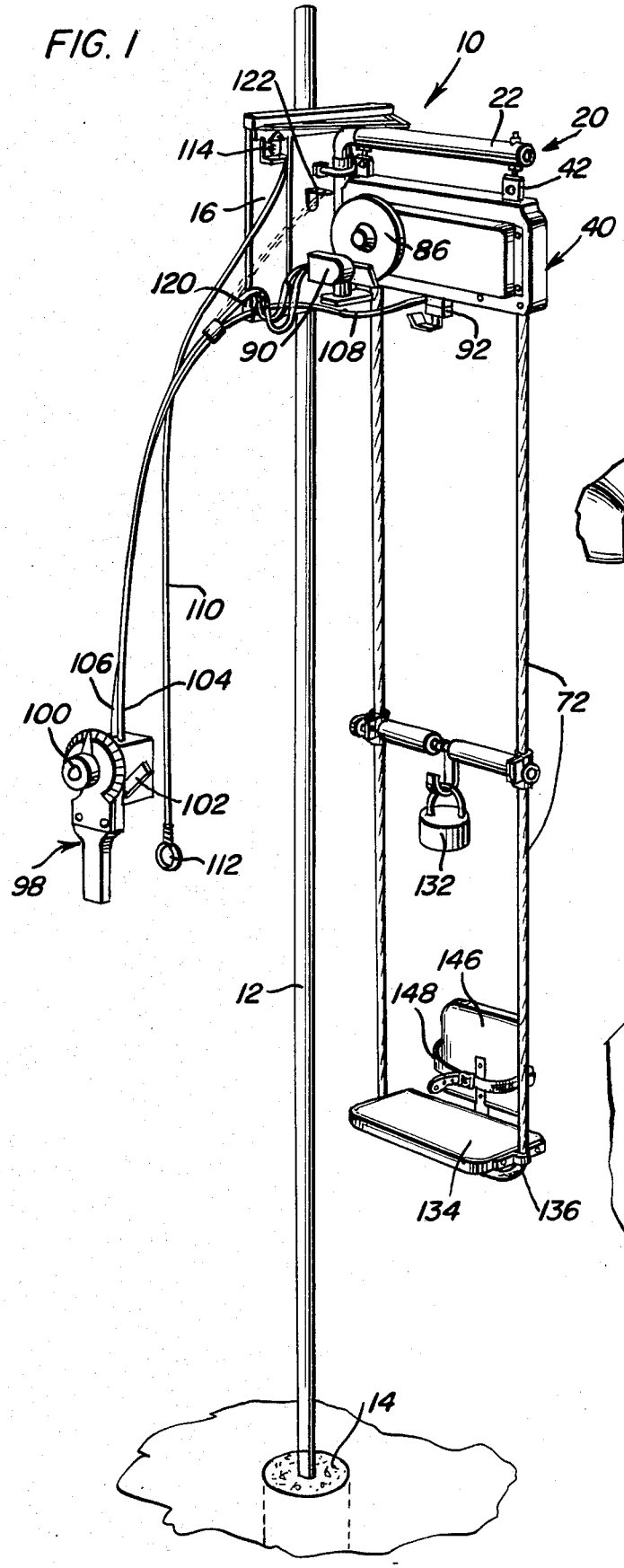
FIG. 1 is a perspective view of the exercise apparatus of the instant invention mounted atop a vertical ground anchored upright.
Figure 8:
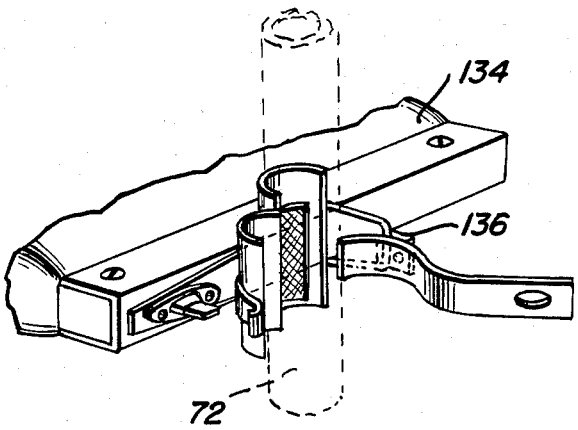
FIG. 8 is a fragmentary perspective view of one end portion of a horizontal seat structure equipped with a releasable clamp for clampingly engaging a corresponding depending reach of the rope.
Figure 9:
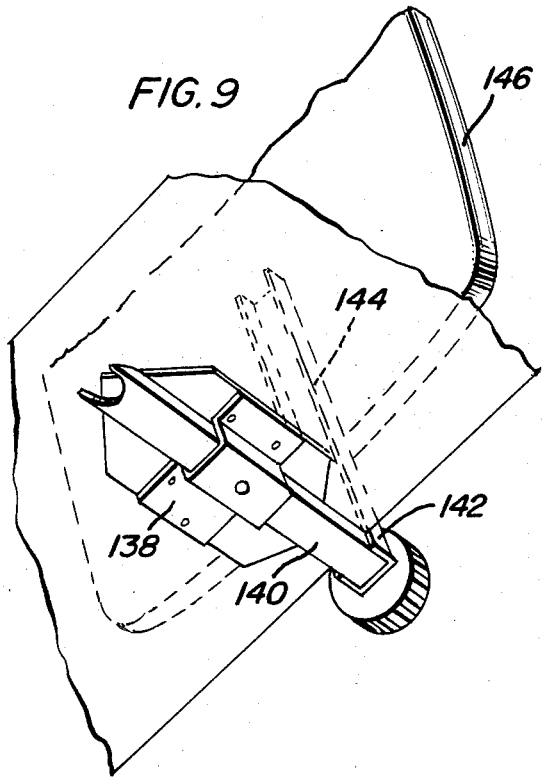
FIG. 9 is a fragmentary perspective view illustrating the seat back and the manner in which the seat back may be removably supported from the seat.
Figure 2:
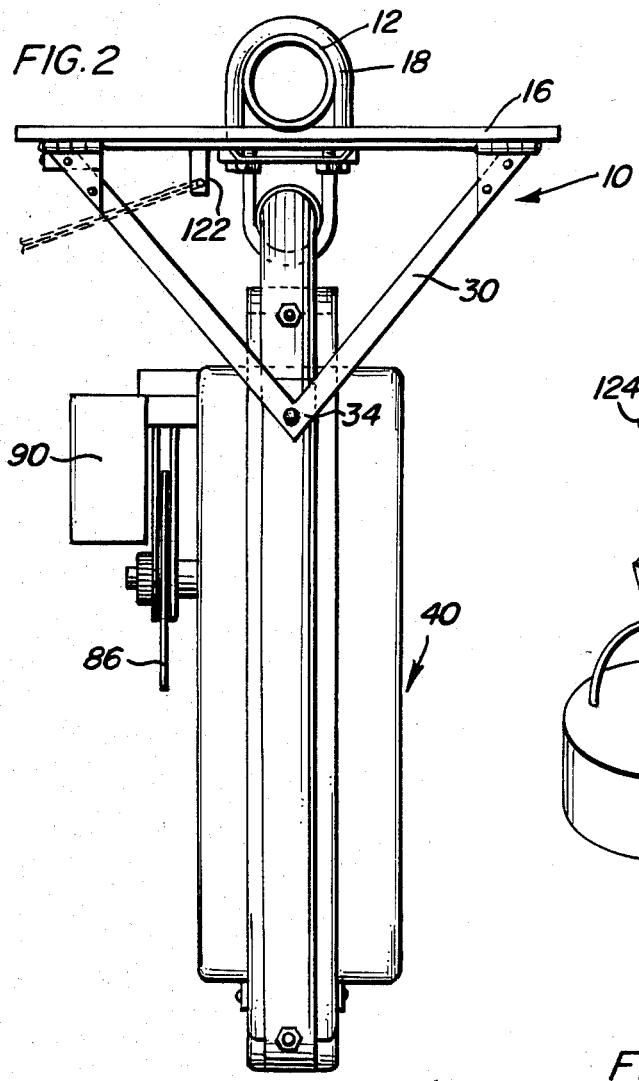
FIG. 2 is an enlarged top plan view of the assemblage illustrated in FIG. 1.

Referring now more specifically to the drawings the numeral 10 generally designates the exercise apparatus of the instant invention. The exercise apparatus 10 includes an upright support post 12 which is ground anchored as at 14 and a vertical mounting panel 16 is mounted atop the support post 12 by U-bolts 18. Alternately, the mounting panel 16 could be anchored relative to the outer or inner surface of a building wall. A support arm structure referred to in general by the reference numeral 20 includes a horizontal arm portion 22 and a vertical arm portion 24. The vertical arm portion 24 is equipped with longitudinally spaced bearing sleeves 26 which are removably journalled in U-bolts 28 supported from the mounting panel 16. Accordingly, the horizontal arm portion 22 may be swung approximately 180° relative to the mounting panel 16. A vertically swingable V-shaped latch frame 30 is hingedly supported from the upper marginal portion of the panel 16 by hinges 32 and the free swinging apex portion 34 of the frame 30 includes a depending latch pin 35 which may be seatingly received in an upwardly opening bore 36 formed in the horizontal arm portion 22 in order to lock the arm portion 22 in position disposed substantially normal to the plane of the mounting panel 16.

The arm portion 22 includes longitudinally spaced depending suspension hooks 38 from which a hollow support housing referred to in general by the reference numeral 40 is supported. The housing 40 includes upwardly projecting apertured support tabs 42 which are removably engaged with and supported from th suspension hooks 38.

The housing 40 is divided into three transversely spaced compartments 44, 46 and 48 and three shafts 50, 52 and 54 are journalled within the housing 40 in horizontal parallel transverse position. One set of ends of the shafts are disposed within the compartment 44 and include sprocket wheels 56, 58 and 60 mounted thereon. An endless chain 62 is trained about the sprocket wheels and includes one reach thereof extending between the sprocket wheels 56 and 60 which is laterally deflected by a spring biased tensioning pulley 62 guidingly engaged therewith. The other set of ends of the shafts project into the compartment 46 and have pulleys 66, 68 and 70 mounted thereon and an elongated section of flexible rope 72 is trained over and about the pulleys and includes generally parallel opposite end portions or reaches which depend downwardly through openings 74 and 76 formed in the bottom wall 78 of the housing 40. The pulley 68 includes a roughened periphery defined by rivits 79 secured therethrough at points spaced circumferentially thereabout. In addition, the shaft 50 includes an end portion thereof which projects into the compartment 48 and has a gear wheel 80 mounted thereon meshed with a second gear wheel 82 carried by a shaft 84 also journalled in the compartment 48 and including a brake disc 86 mounted thereon. The brake disc 86 has a manually adjustable brake caliper assembly 90 supported from the exterior of the housing 40 operatively associated therewith for frictionally braking the disc 86.

Figure 4:
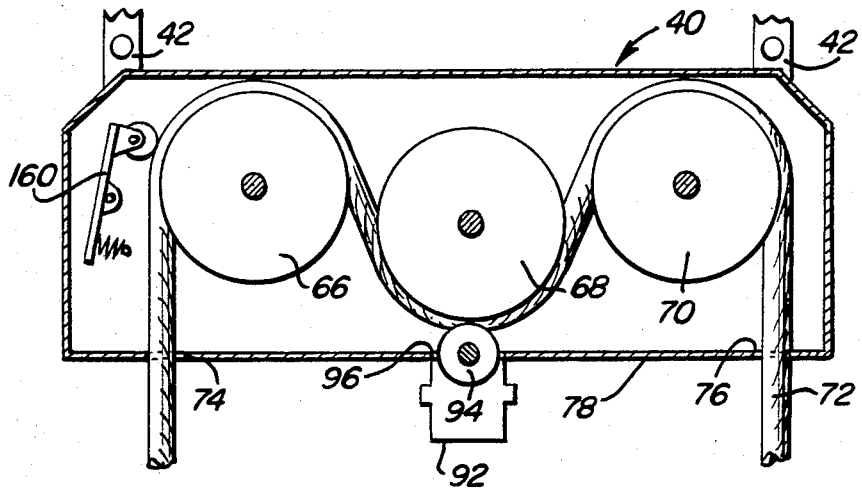
FIG. 4 is a fragmentary vertical sectional view of the upper portion of the apparatus illustrating the threading of the rope member through the rope guiding pulleys of the exercise apparatus.
Figure 5:
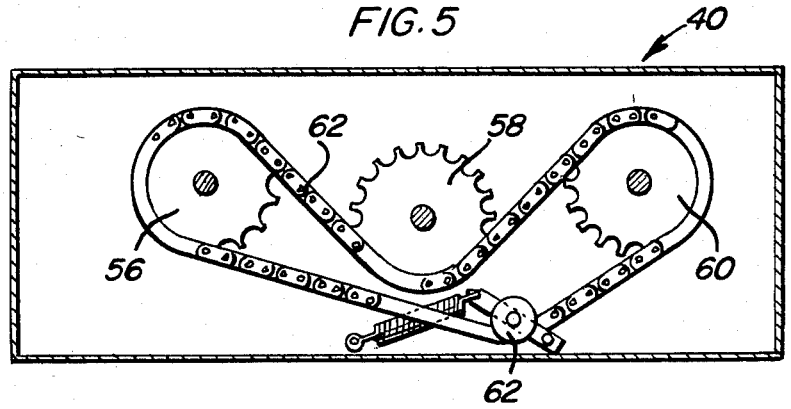
FIG. 5 is a fragmentary vertical sectional view illustrating the power train of the exercise apparatus by which the various rope guiding pulleys are drivingly connected for equal angular displacement.
Figure 6:
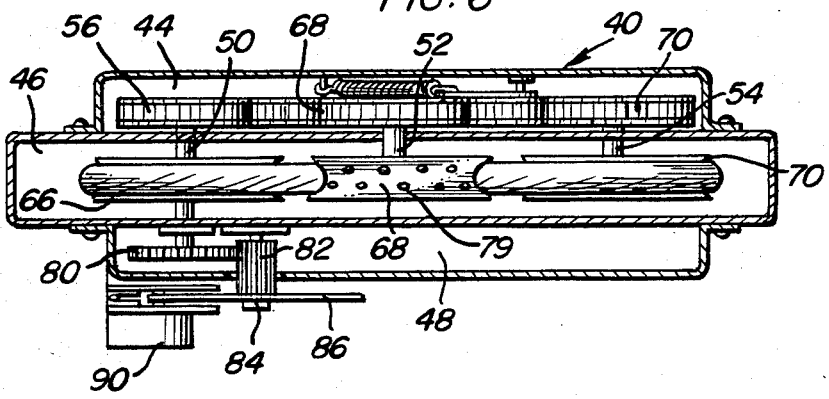
FIG. 6 is a fragmentary horizontal sectional view of the upper support portion of the exercise apparatus.
Figure 10:
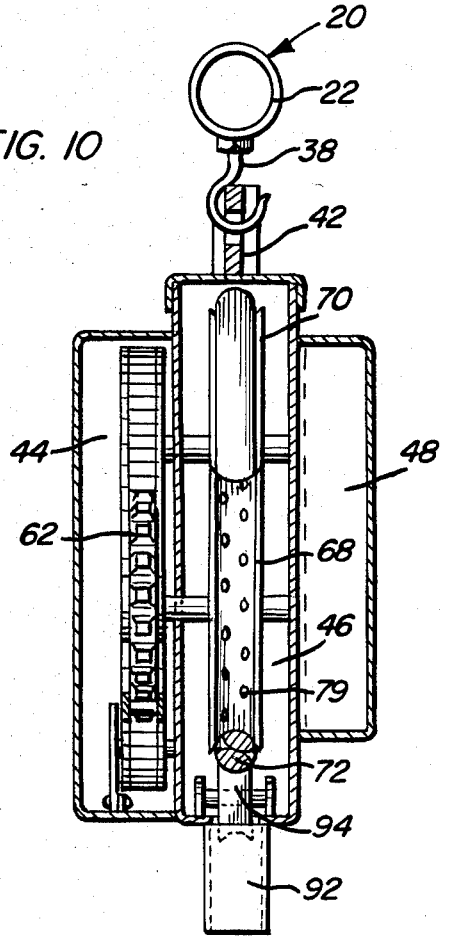
FIG. 10 is a vertical transverse sectional view taken substantially upon the plane indicated by the section line 10—10 of FIG. 3.

A spring mounted linear movement distance gauge 92 is mounted from the bottom wall 78 of the housing 40 and includes an actuating friction wheel 94 which projects upwardly through a third opening 96 formed in the bottom wall 78 for frictionally engaging that portion of the rope 72 which passes beneath the pulley 68, see FIG. 4.

Figure 3:
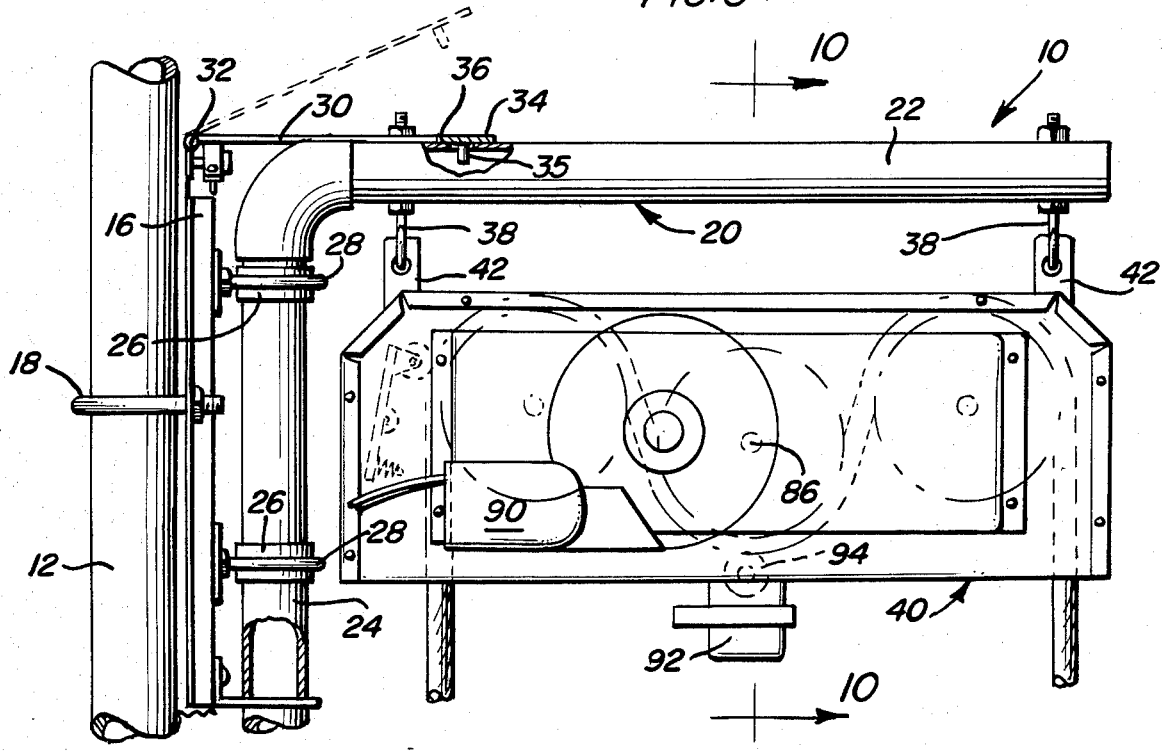
FIG. 3 is a fragmentary side elevational view of the upper portion of the exercise apparatus.

A remote manually operable control assembly referred to in general by the reference numeral 98 is provided and includes a first rotatable control member 100 and a second pivotable control member 102. The control member 100 is operatively connected to the brake caliper assembly 90 through the utilization of a pair of flexible motion transmitting cables 104 and 106 and the control member 102 is operatively connected with the gauge 92 for resetting the latter by a third flexible motion transmitting cable 108. In addition, a flexible pull line 110 is equipped with a pull ring 112 on one end and the other end of the pull line 110 is operatively connected to a latch release assembly 114 which, when actuated, is operative to upwardly displace the latch frame 30 from the active solid line position thereof in FIG. 3 toward the inactive phantom line position of FIG. 3. Further, an elongated chain 120 is provided and has one end anchored relative to a bracket 122 on the mounting panel 16 and the other end is anchored relative to the control assembly 98 for support of the latter from the mounting panel 16 independent of the cables 104, 106 and 108.

Figure 12:
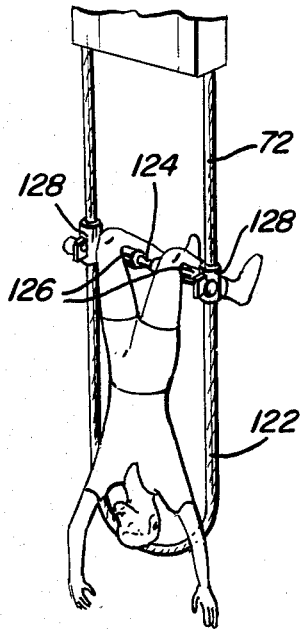
FIG. 12 is a perspective view illustrating the manner in which the chinning bar of the exercise apparatus may be used.

The ends of the rope 72 are removably joined together in aligned relation in any suitable manner (not shown) and accordingly, the depending portion of the rope 72 defines an upwardly opening loop 122, see FIG. 12. Further, a horizontally elongated chinning bar 124 is provided and includes padding sleeves 126 on its opposite end portions as well as releasable clamp assemblies 128. The releasable clamp assemblies 128 may be clampingly engaged with the depending reaches of the rope 72 in the manner illustrated in FIG. 12 and the central portion of the chinning bar 124 may also be used to removably support a support hook 130 therefrom with the support hook 130 being usable to removably support any suitable type of weight 132, see FIG. 7.

A horizontal seat 134 is also provided and includes opposite end releasable clamp structure 136 for clampingly engaging the depending reaches of the rope 72 in the manner illustrated in FIG. 1 and the underside of the seat 134 includes a bracket 138 supported therefrom from which the horizontal leg 140 of an L-shaped mounting bracket 142 may be removably supported. The mounting bracket 142 additionally includes a vertical leg 144 from which a seat back 146 is supported and the seat back 146 may include a child restraint belt 148, if desired.

Figure 11:
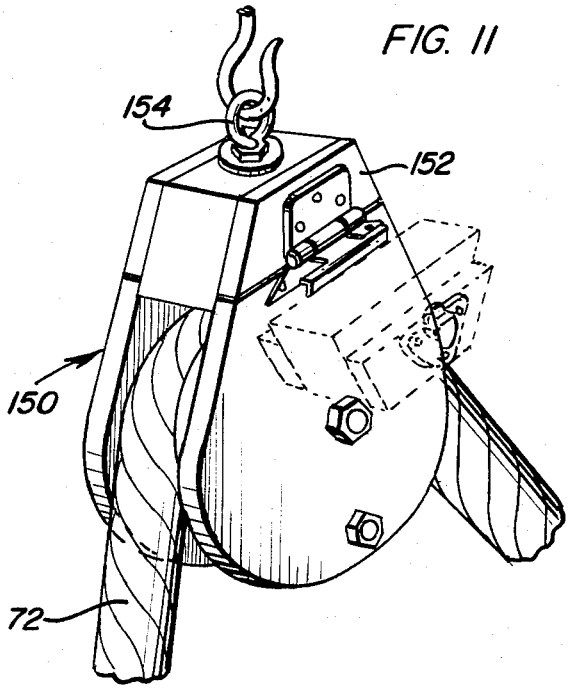
FIG. 11 is a perspective view of a pulley block accessory to be used in conjunction with the exercise apparatus.
Figure 13:
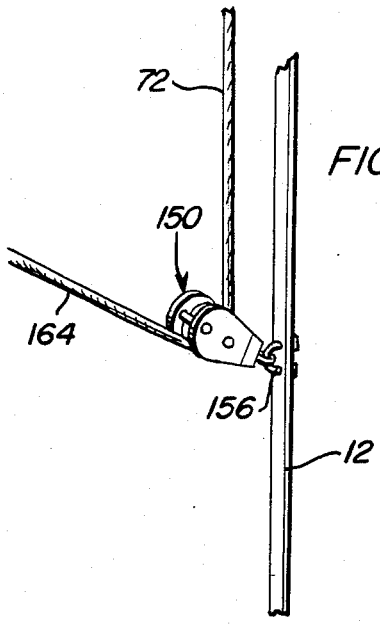
FIG. 13 is a perspective view illustrating the manner in which the pulley block accessory illustrated in FIG. 11 may be used.

With attention now invited more specifically to FIG. 11 of the drawings, there may be seen a pulley block referred to in general by the reference numeral 150 and which includes an openable (pivoted) portion 152 equipped with an anchor eye 154. The openable portion 152 may be opened in order that a portion of the rope 72 may be laterally engaged therewith and the lower portion of the support post 12 may include an anchor member 156 to which the eye 154 may be removably anchored, see FIG. 13.

In operation, after the exercise apparatus has been properly installed and when the support arm structure 20 has been pivoted and latched in the operative position, the brake caliper assembly 90 may be adjusted as desired to effect a frictional drag on the disc 86 to thereby frictionally resist longitudinal displacement of the rope 72 about the pulleys 66, 68 and 70. A spring biased idle wheel equipped follower 160 is provided within the housing 40 to help maintain the rope 72 in good frictional engagement with the pulley 66. After the brake caliper assembly 90 has been adjusted, the user of the exercise apparatus 10 may attempt to "climb" that reach of the rope furthest the support post 12. If the brake caliper assembly 90 has been tightened sufficiently, the weight of the user will not be sufficient to effect longitudinal displacement of the rope 72 about the pulleys 66, 68 and 70. Therefore, the user, in order to climb the rope, must be capable of lifting his own weight upwardly along the rope 72. However, if the brake caliper assembly has been adjusted to effect a slight frictional resistance to rotation of the shaft 50, the person attempting to climb the reach of the rope 72 furthest from the support post 12 may carry out all of the rope climbing arm exercises with a lesser amount of effort than would be required to raise himself along the rope 72. In addition, the pulley block 150 may be engaged with the rope 72 and mounted in the manner illustrated in FIG. 13. In this manner, the user of the exercise apparatus may exert an upwardly pull on the inclined portion 164 of the rope 72 with the desired resistance to longitudinal displacement of the rope 72 being effected by the brake caliper assembly 90.

Figure 7:
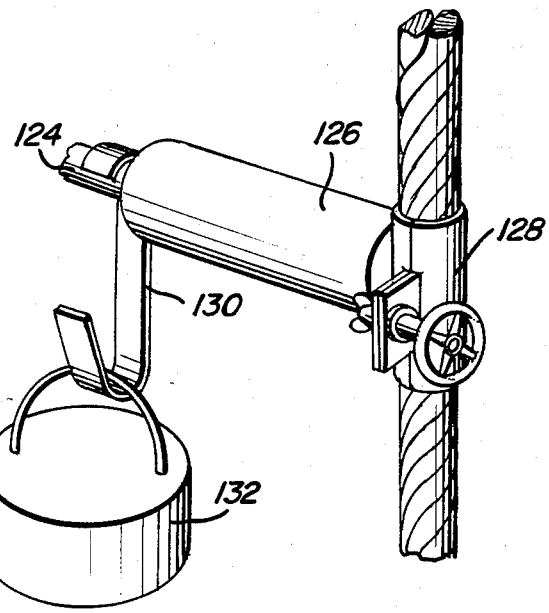
FIG. 7 is a fragmentary perspective view illustrating the manner in which one end portion of a horizontal chinning bar may be clamped relative to one depending reach of the rope and the manner in which a weighted member may be supported from the central portion of the chinning bar.

As hereinbefore set forth, the chinning bar 124 may be secured between the depending reaches of the rope 72 in the manner illustrated in FIG. 12 of the drawings. Further, as illustrated in FIGS. 1 and 7, the weight 132 may be added to the bar 124, when the chinning bar 124 is used alone, it may be grasped by the hands of the user for "chinning" or it may be engaged behind the knees of the user in the manner illustrated in FIG. 12 in order that the user may effect "sit-up" exercises. Still further, the seat 134 may be secured between the depending reaches of the rope 172 at the bottom of the loop 136 in the manner illustrated in FIG. 1 in order to form a swing. In addition, the seat back 146 may be removably attached to the seat 134 in order that a swing for small children or infants may be provided. Still further, the seat 134 may be secured between upper portions of the depending reaches of the rope 72 and the chinning bar 124 with the weight 132 supported therefrom may be secured between the rope reaches below the seat 134. In this manner, the use of the exercise apparatus 10 may seat himself on the seat 134 with his feet engaging the weighted chinning bar 124 in order to effect leg exercises. In addition, it will be apparent that various other exercises may be effected through utilization of the exercise apparatus.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rope climbing apparatus including support structure for support in elevated position above a support surface from which a user of the apparatus may be supported, an elongated section of flexible tension member, said support structure including tension member support and guide means supporting and guiding said tension member from said support structure for longitudinal shifting relative thereto and with a portion of the tension member depending downwardly from said support structure, said support and guide means including adjustable brake means variably braking said tension member against longitudinal shifting relative to said support and guide means, said brake means including remotely controllable adjustment means incorporating an adjustably shifting control member and elongated flexible connecting means connecting said control member and said brake means for adjustment thereof from said remote adjustment means, an inverted L-shaped support arm structure including an upper horizontal arm portion and a vertical arm portion depending downwardly from one end of said horizontal arm portion, means oscillatably supporting said vertical arm portion from a suitable support for angular displacement about its longitudinal axis, said support structure being removably supported from said horizontal arm portion.

2. The rope climbing apparatus of claim 1 wherein said tension member is longitudinally continuous and said portion depending downwardly from said support structure comprises an upwardly opening loop.

3. The rope climbing apparatus of claim 2 wherein said support and guide means includes means for depending support of a pair of generally parallel reaches of said tension member therefrom, the lower ends of said depending reaches being connected by an upwardly opening curved integral portion of said tension member forming, together with said depending reaches, said loop.

4. The rope climbing apparatus of claim 3 including a chinning bar having tension member clamp means on its opposite ends for releasable clamped engagement with said reaches intermediate their opposite ends.

5. The rope climbing apparatus of claim 3 including a horizontally elongated seat member having tension member clamp means on its opposite ends for releasable clamped engagement with said reaches intermediate their opposite ends.

6. The rope climbing apparatus of claim 1 wherein said brake means comprises adjustable friction brake means.

7. The rope climbing apparatus of claim 1 including a pulley block releasably anchorable relative to said support structure below the latter and with which said depending portion of said tension member may be laterally operably engaged.

8. The rope climbing apparatus of claim 1 including means operative to releasably latch said support arm structure in adjusted angularly displaced position.

9. The rope climbing apparatus of claim 1 including means supporting said support structure from said horizontal arm portion for angular displacement about an axis generally paralleling said horizontal arm portion.

10. The rope climbing apparatus of claim 1 including linear movement gauge means mounted from said support structure, engaged with said tension member and operative to indicate the distance said tension member is longitudinally shifted relative to said support structure.

11. A rope climbing apparatus including a stationarily supported elongated horizontal support portion, a horizontally elongated support structure, means mounting said elongated support structure from said support portion for angular displacement of said support structure relative to said support portion about an axis generally paralleling said support portion and support structure, an elongated endless flexible tension member, said support structre including tension member support and guide means spaced longitudinally thereof supporting and guiding said tension member from said support structure for longitudinal shifting relative thereto and with elongated reaches of said tension member depending downwardly from opposite end portions of said support structure and joined at their lower ends by an integral upwardly opening loop portion of said tension member, said tension member support and guide means including an adjustable brake means variably braking said tension member against longitudinal shifting relative to said guide means, and elongated load supporting means extending between lower end portions of said reaches and having opposite end portions thereof anchored relative to said reaches.

12. The rope climbing apparatus of claim 11 wherein said brake means includes remotely controllable adjustment means incorporating and adjustable adjustment means incorporating an adjustably shiftable control member, and elongated flexible connecting means connecting said control member and said brake means for adjustment thereof from said remote adjustment means.

* * * * *